US005402996A

United States Patent [19]

Long

[11] Patent Number: 5,402,996

[45] Date of Patent: Apr. 4, 1995

[54] APPARATUS AND METHOD FOR FEEDING CARDS FROM SELECTED CARD STACKS USING A CONTINUOUSLY ROTATING DRIVE

[76] Inventor: John A. Long, 41 Lamont Avenue, Scarborough, Ontario, Canada, M1S 1A8

[21] Appl. No.: 197,028

[22] Filed: Feb. 16, 1994

[51] Int. Cl.[6] ..... B65H 3/44; B65H 3/04

[52] U.S. Cl. ..... 271/9; 271/10; 271/35; 271/114; 271/121; 271/265; 271/266; 198/835

[58] Field of Search ..... 271/9, 10, 35, 114, 271/121, 258, 265, 266; 198/575, 576, 835; 474/84, 85, 88, 62

[56] References Cited

U.S. PATENT DOCUMENTS

| | | | |
|---|---|---|---|
| 2,583,471 | 1/1952 | Collis | 198/835 |
| 3,291,286 | 12/1966 | Adams | 198/835 |
| 3,291,287 | 12/1966 | Rehm | 198/835 X |
| 4,651,983 | 3/1987 | Long . | |
| 4,966,357 | 10/1990 | Burger | 271/9 |
| 5,129,641 | 7/1992 | Long | 271/35 X |
| 5,141,216 | 8/1992 | Ballestrazzi | 271/9 X |

FOREIGN PATENT DOCUMENTS

| | | | |
|---|---|---|---|
| 1235096 | 5/1963 | Germany | 198/835 |
| 1402513 | 6/1988 | U.S.S.R. | 198/835 |

*Primary Examiner*—Robert P. Olszewski
*Assistant Examiner*—Borus Milef

[57] ABSTRACT

A number of card feeders comprise a feed belt underlying a friction wheel operated by a pulsed drive. A continuously rotating drive shaft may be coupled to a selected feeder by an air cylinder which retracts under control of a controller to translate a guide wheel of the feed belt of the selected feeder so that the feed belt moves into contact with a drive wheel rotated by the continuously rotating drive shaft. The pulsed friction wheel rotates through an arc in order to drop a card from a stack of cards partially supported by the friction wheel onto the now moving feed belt. A downstream card sensor, when sensing that a card has been delivered, signals the controller so that the controller operates the air cylinder to extend it to decouple the feed belt from the drive shaft.

14 Claims, 3 Drawing Sheets

APPARATUS AND METHOD FOR FEEDING CARDS FROM SELECTED CARD STACKS USING A CONTINUOUSLY ROTATING DRIVE

BACKGROUND OF THE INVENTION

1. Field of the Invention

This invention relates to apparatus and a method for selectively feeding cards and like paper stock singly from a plurality of stacks thereof. 2. Description of the Related Art My U.S. Pat. No. 4,651,983 which issued Mar. 24, 1987 describes a card feeder for selectively feeding cards from a stack thereof. Where it is desired to feed from more than one stack, for example, when selected inserts are to be fed onto a conveyor, multiple ones of such feeders may be employed and coordinated with a common controller. However, this provides an expensive solution.

Accordingly, there remains a need for a cost effective manner of selectively feeding cards from a plurality of card stacks.

SUMMARY OF THE INVENTION

According to the present invention, there is provided apparatus for selectively feeding cards and like paper stock singly from a plurality of stacks thereof, comprising: a plurality of stack guides; a drive for continuously rotating; associated with each stack guide of said plurality of stack guides, a feed belt, a friction wheel spaced above said feed belt so as to provide a gap through which cards may be singly fed from the bottom of a stack of cards supported by said stack guide, means to pulse said friction wheel, and means, when activated, for coupling said feed belt to said continuously rotating drive in order to drive said feed belt and, when deactivated, for decoupling said feed belt from said continuously rotating drive; control means for selectively activate said coupling means associated with a stack guide of said plurality of stack guides in order to feed a card from a stack of cards.

In accordance with another aspect of this invention, there is provided a method of selectively feeding cards and like paper stock singly from a plurality of stacks thereof, comprising the following steps: continuously rotating a drive shaft having a plurality of drive wheels thereon; selectively moving a guide wheel of at least one feed belt associated with said plurality of drive wheels such that one or more selected feed belts contact associated ones of said plurality of drive wheels and are thereby driven; stepping a friction wheel spaced above each of said selected feed belts so that a card from a stack of cards supported in part by said friction wheel is singly fed from the bottom of said stack into a gap between said friction wheel and said selected feed belt.

BRIEF DESCRIPTION OF THE DRAWINGS

In the Figures which disclose example embodiments of the invention.

DESCRIPTION OF THE PREFERRED EMBODIMENTS

Figure 1:
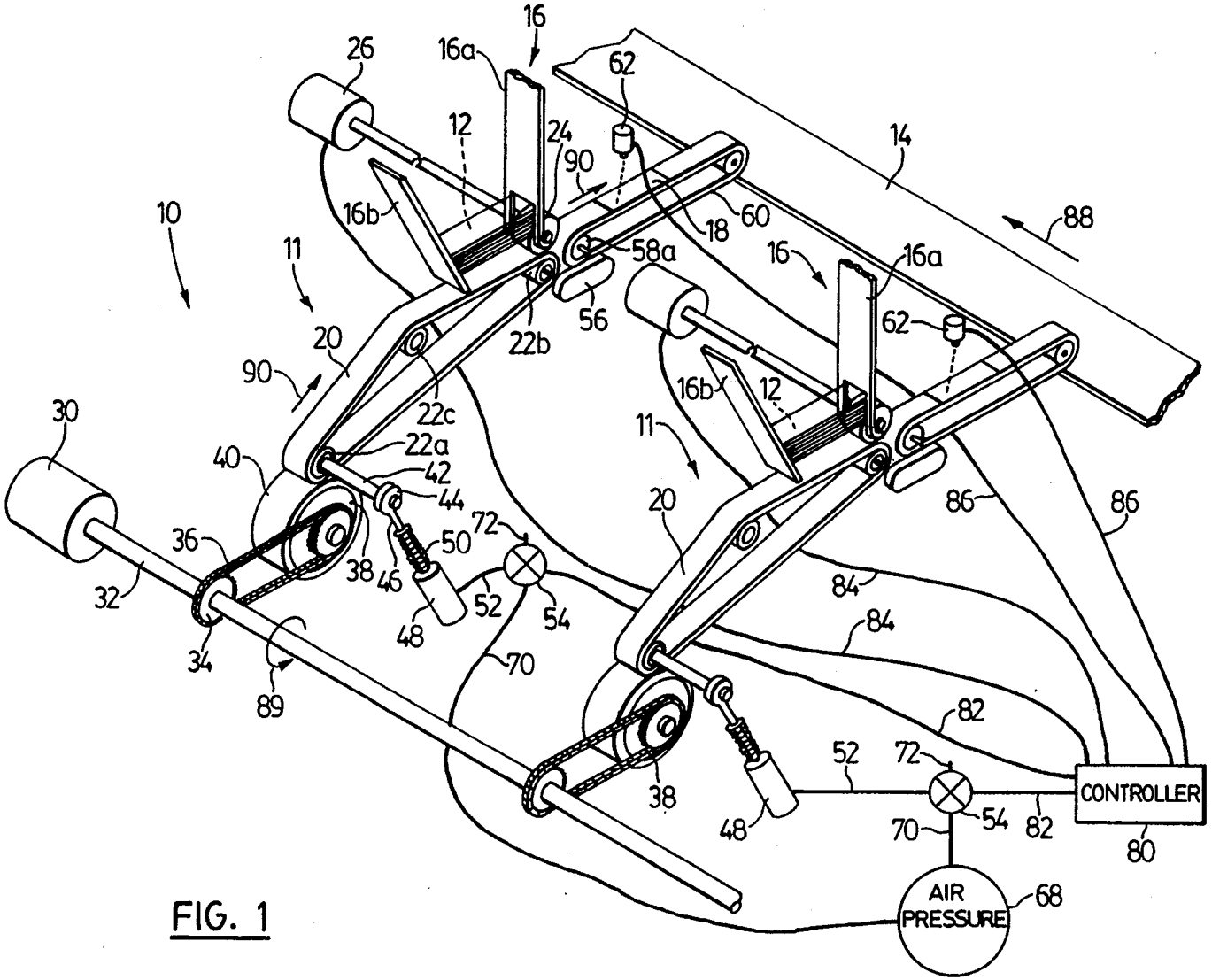
FIG. 1 is a perspective view of apparatus made in accordance with this invention.

With reference to FIG. 1, 10 designates generally the apparatus of this invention for selectively feeding cards 18 from a plurality of stacks 12 of cards to a conveyor 14. The apparatus 10 comprises a plurality of feeders 11, each with a stack guide 16 for a stack 12 of cards. The stack guides have a front guide plate 16*a* and a rear guide plate 16*b*. For each feeder 11, a feed belt 20 is positioned below stack guide 16. The feed belt rides on guide wheels 22*a*, 22*b*, and 22*c* such that the feed belt has a generally triangular configuration. A friction wheel 24 is received within a notch of the front guide plate 16*a* so that the lower front edge of each stack 12 of cards is in contact with the friction wheel 24. The friction wheel is spaced above feed belt 20 in order to provide a gap between it and the feed belt 20. A stepping motor 26 is connected to each friction wheel.

Each guide wheel 22*a* is supported by a guide shaft 42 which is mounted on a ring bearing 44. The piston 46 of a cylinder 48 is coupled to the ring bearing 44. A spring 50 on piston 46 urges the piston to an extended position. The outlet line 52 of a valve 54 is connected to cylinder 48. An inlet 72 of valve 54 is vented to atmosphere.

Guide wheel 22*a* of feed belt 20 is connected through transmission 56 to guide wheel 58*a* of downstream feed belt 60. A card sensor 62 overlies downstream feed belt 60. The downstream feed belt 60 extends between feed belt 20 and conveyor 14.

Apparatus 10 has a drive motor 30 with a drive shaft 32. Spur gears 34 and chain belts 36 couple the drive shaft 32 to drive wheels 38. Each drive wheel has a resilient face 40. One drive wheel is provided for each feeder 11 and underlies guide wheel 22*a* of feed belt 20. Apparatus 10 also has an air pressure source 68 connected to an inlet line 70 of each valve 54. A controller 80 is connected to the control line 82 of each valve 54 as well as to the control line 84 of each stepping motor 26. The signal output line 86 of each card sensor 62 is fed to controller 80.

In describing the operation of the apparatus 10, it is assumed that the starting position for the apparatus is shown in FIG. 1 with a card 18 positioned on each downstream feed belt 60 under card sensor 62. Conveyor 14 conveys in a downstream direction 88. Drive motor 30 continuously rotates drive shaft 32, and therefore drive wheels 38, in a counterclockwise direction 89. Information is fed to controller 80 to dispense cards from certain feeders 11 at certain times. Based on this information, controller 80 sends valve actuation signals on selected ones of valve control lines 82 in order to couple the source of air pressure 68 to the cylinders 48 of selected feeders. This causes the pistons 46 of these cylinders to retract thereby translating the guide wheels 22*a* of the selected feeders so that the feed belts 20 of these feeders are brought into contact with the resilient face 40 of an underlying drive wheel 38. In consequence, feed belt 20 and (due to transmission 56) downstream feed belt 60 of each selected feeder are driven by a drive wheel 38 in a downstream direction 90 causing the card 18 on the downstream feed belt 60 to be dispensed to conveyor 14.

At about the same time as issuing a control signal on valve control lines 82 of selected feeders, the controller issues control signals on lines 84 to these feeders such that the stepper motors of each selected feeder rotates the feeder's friction wheel 24 through an arc sufficient to separate the bottom cards in the stack and ensure that the bottom-most card is dropped from the stack 12 of cards onto feed belt 20. Once on feed belt 20, the card moves along the feed belt through the gap between the friction wheel 24 and along downstream feed belt 60. When the travelling card 18 interrupts card sensor 62 of a feeder 11, the card sensor sends a signal on the line 86 to the controller 80. This prompts the controller to send a signal on line 82 to the valve 54 associated with the same feeder in order to operate the valve to couple the vented inlet 72 to cylinder 48. When cylinder 48 is vented, spring 50 causes the piston 46 of the cylinder to extend in order to move guide wheel 22a out of contact with drive wheel 38. In this way, the feed belt of the feeder 11 is stopped with a card 18 on downstream feed belt 60 ready for dispensing when that feeder is again selected.

In summary, when the controller activates a feeder 11, the feeder dispenses a card 18 which had been resting on feed belt 60 to conveyor 14, dispenses another card from stack 12, and continues to operate until this other card reaches a predetermined location whereat it interrupts card sensor 62 on feed belt 60.

When stacks 12 of cards are first placed within the stack guide 16 of each card feeder 11, the controller may be prompted to activate each card feeder in order to feed a card from the stack and along the downstream feed belt 60 until the card interrupts card sensor 62, as shown in FIG. 1. The apparatus 10 is then ready for operation as described hereinbefore.

While FIG. 1 shows only two card feeders 11, obviously as many card feeders 11 as desired may be added with a drive wheel 38 being provided for each card feeder 11.

Figure 2:
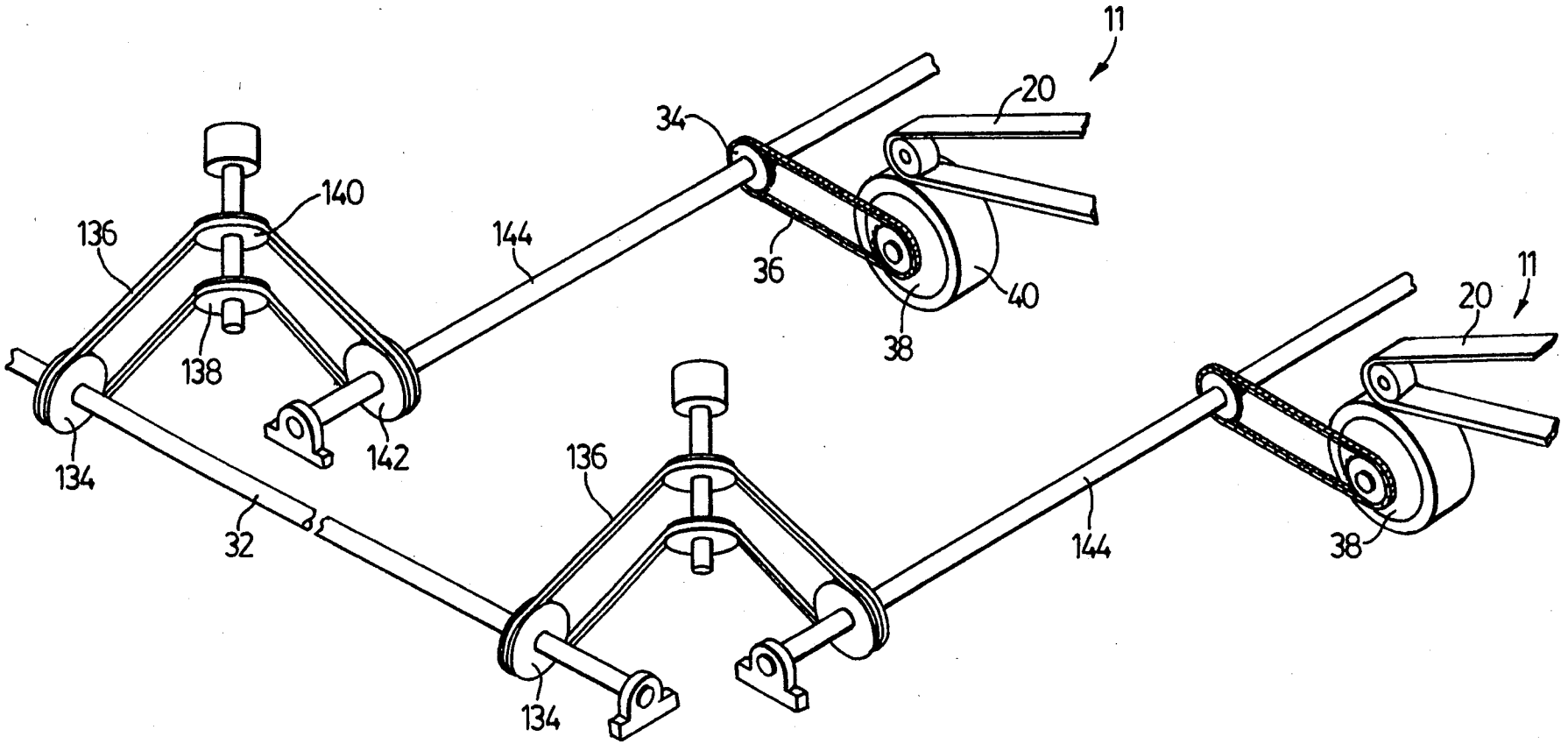
FIG. 2 is a fragmentary perspective view of another embodiment of the present invention.

The apparatus 10 feeds cards 18 to a conveyor 14 which moves transversely of the downstream direction 90 in which the cards 12 are fed by feeders 11. In order to feed the cards to an in-line conveyor, the apparatus may be modified as shown in FIG. 2. With reference to FIG. 2, drive shaft 32 supports drive wheels 134. A drive belt 136 extends around each drive wheel 134 and over a pair of support wheels 138 and 140 to driven wheel 142. Driven wheel 142 is keyed to output shaft 144. A spur gear 34 is mounted to each driven shaft 144. As before, a chain belt links the spur gear to drive wheel 38 and a feed belt 20 of a feeder 11 is positioned over each drive wheel 38. The drive belt 136 changes the direction of torque imparted by drive shaft 32 by ninety degrees such that driven shaft 144 is normal to drive shaft 32. Consequently, card feeders 11 may be positioned in line with each other so that they will feed cards in line.

Figure 3:
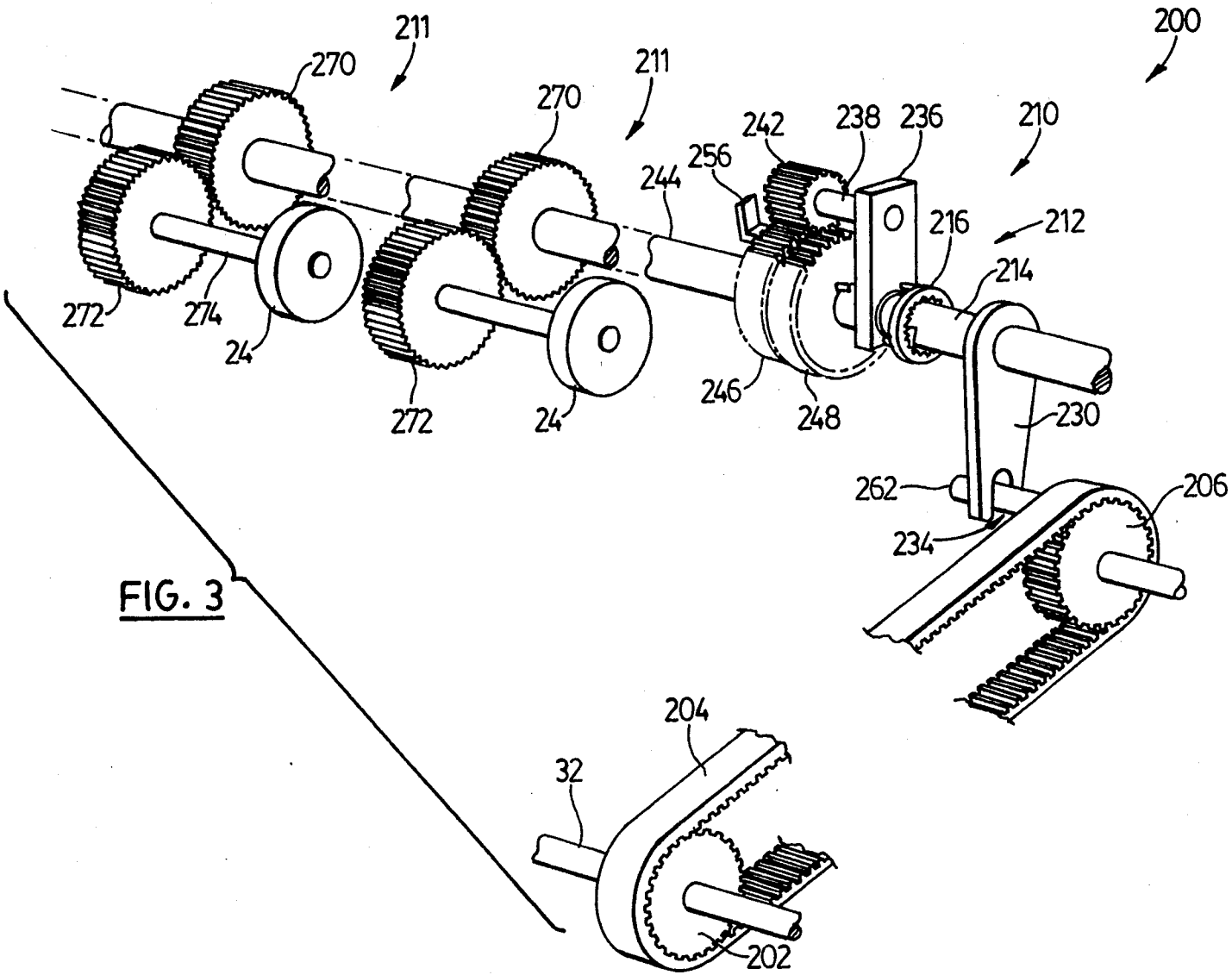
FIG. 3 is fragmentary perspective view of another embodiment of the present invention.

FIG. 3 illustrates another embodiment of this invention which avoids the need for stepper motors. With reference to FIG. 3, wherein like parts have been given like reference numerals, apparatus 200 has a toothed feed wheel 202 keyed to drive shaft 32. The teeth of the feed wheel 202 mesh with a feed belt 204. A toothed feed wheel 206 having an eccentric cam shaft 262 also meshes with the feed belt. The cam shaft 262 is received within a slot 234 of a pendulum 230 of gear transmission 210. Gear transmission 210 is of the type described in co-pending application number Ser. No. 08/093,624 filed Jul. 20, 1993, the contents of which are incorporated herein by reference. Gear transmission 210 converts a constant rotary motion into a pulsed rotary motion. Briefly, gear transmission 210 comprises a oneway clutch 212 with pendulum 230 depending from the input shaft 214 of the clutch. A support arm 236 is supported by a sleeve bearing on clutch shaft 214 and is affixed to the output member 216 of the clutch. Arm 236 terminates in a shaft 238 which rotatably supports planetary spur gear 242. The planetary gear 242 meshes with sun gears 246 and 248 which are supported on an output shaft 244. Sun gear 246 is fixed against rotation by tag 256. Sun gear 248 is keyed to the output shaft 244 so that the shaft 244 rotates with sun gear 248. The clutch input shaft 214 is co-axial with the output shaft 244 but is not constrained to rotate with the output shaft.

Fixed sun gear 246 has a slightly different number of teeth than does rotatable sun gear 248. For example, the fixed gear 246 may have fifty-one teeth and rotatable gear 248 may have fifty teeth. Accordingly, planetary gear 242, and sun gears 246, 248 are set up as harmonic gears.

Spur gears 270 are keyed to the output shaft 244. Each spur gear 270 meshes with a spur gear 272. The feed wheel 24 of each feeder 211 is supported by a shaft 274 for rotation with a spur gear 272.

In operation of the gear transmission 210, when spur gear 206 moves through one revolution eccentric cam shaft 262 rocks the pendulum 230 back and forth through one cycle. Since pendulum 230 is joined to the input member 214 of one-way clutch 212, this input member 214 rotates alternately in a clockwise sense and then in a counterclockwise sense as the pendulum progresses through its cycle. The input and output members of the clutch lock together when the pendulum rocks in one sense and rotate arm 236, which depends from the output member of the clutch, through an arc which is determined by the eccentricity of cam 262.

Planetary gear 242 moves with support arm 236 and meshes with sun gears 246,248. Since the fixed sun gear 246 and the rotatable sun gear 248 have a different number of teeth, as the planetary gear moves through an arc about the sun gears, the rotatable gear 248 is caused to rotate through a small part of a revolution. This operation of these harmonic gears will be well understood to those skilled in the art. Since the output shaft 244 is keyed to the rotatable sun gear 248, when gear 248 moves through a small part of an arc, the output shaft moves with it.

In the operation of the apparatus of FIG. 3, drive shaft 32 is continuously driven which, due to gear transmission 210, results in the output shaft 244 being pulsed at regular intervals. However, the feed wheel 24 of each feeder 211 is geared to the output shaft 244. Accordingly, the feed wheel 24 of each feeder is also pulsed through an arc at regular intervals. The apparatus 200 of FIG. 3 omits the stepper motors of FIG. 1 and the control lines to these motors and utilises gear transmission 210 instead; otherwise, apparatus 200 is identical to the apparatus 10 of FIG. 1. Accordingly, a controller selectively activates the feed belts of feeders 211. Since the feed wheel 24 of each feeder 211 is regularly pulsed, it is certain that a card will be resting on the feed belt of the selected feeders for feeding downstream. On the other hand, regularly pulsing the feed wheels of each feeder will not normally drop more than one card onto the feed belt of idle feeders (i.e., feeders which are not selected for a period of time) due to the small space between the bottom of the stack of cards and the feed belt which only accommodates one card. Further, at least provided each feeder is selected fairly regularly, the feed wheel 24 by itself will not have an opportunity to feed the bottom card by degrees through the nip between the feed wheel and the feed belt.

Regularly pulsing the feed wheel 24 of a feeder with the apparatus of FIG. 3 could result in feeding more than card from the feeder 211 when it is selected if the feeder either carries thin card stock (such that the gap between the bottom of the stack and the feed belt can accommodate more than one card) or remains idle for a long period of time. To avoid improper feeding, feeders which could cause problems should be identified and the spur gear 272 associated with such feeders removed and replaced with a stepper motor which is under the control of the controller. This results in a hybrid machine, with the feed wheels of some feeders being regularly pulsed and the feed wheels of others being pulsed by stepper motors.

The apparatus of the present invention requires only one drive motor for the feed belts of the feeders. Avoiding individual drive motors for each feeder and the necessary power supply for each such motor can result in a per feeder cost saving of up to fifty percent.

Other modifications to the invention will be apparent to those skilled in the art and, therefore, the invention is defined in the claims.

What is claimed is:

1. Apparatus for selectively feeding sheets singly from a plurality of stacks thereof, comprising:

a plurality of stack guides;

a drive for continuously rotating, said drive comprising a plurality of drive wheels;

associated with each stack guide of said plurality of stack guides, a feed belt, having a guide wheel, a friction wheel spaced above said feed belt so as to provide a gap through which sheets may be singly fed from the bottom of a stack of sheets supported by said stack guide, means to pulse said friction wheel, and means, when activated, for coupling said feed belt to said continuously rotating drive in order to drive said feed belt and, when de-activated, for decoupling said feed belt from said continuously rotating drive; said coupling means comprising means to translate said guide wheel such that said feed belt contracts one of said drive wheels;

control means for selectively activating said coupling means associated with a stack guide of said plurality of stack guides in order to feed a sheet from a stack of sheets.

2. The apparatus of claim 1 wherein said means to pulse said friction wheel comprises a stepping motor and wherein said control means is also for activating said stepping motor associated with a stack guide of said plurality of stack guides when activating said coupling means associated with said stack guide of said plurality of stack guides.

3. The apparatus of claim 1 wherein each of said drive wheels has a resilient face.

4. The apparatus of claim 3 wherein said guide wheel translation means comprises a cylinder having a piston connected to a bearing supporting said guide wheel, said cylinder for selectively retracting said piston and extending said piston.

5. The apparatus of claim 4 wherein said translation means comprises a source of air pressure coupled to said cylinder through a valve and wherein said control means is connected to a control input of said valve.

6. The apparatus of claim 4 wherein said translation means comprises a source of air pressure and a two-inlet valve, said source of air pressure being coupled to an inlet of said valve, another inlet of said valve being vented to atmosphere, a valve outlet being coupled to said cylinder and wherein said control means is connected to a control input of said valve.

7. The apparatus of claim 5 including means to bias said piston to a position whereat said feed belt is not in contact with one of said resilient faced drive wheels.

8. The apparatus of claim 1 including sheet sensing means for sensing a sheet at a pre-determined location downstream of said gap between said friction wheel and said feed belt, said sheet sensing means having an output operatively associated with said control means for prompting said control means to deactivate said coupling means in order to decouple said feed belt from said continuously rotating drive.

9. The apparatus of claim 1 including a downstream feed belt operatively coupled to said feed belt having a guide wheel for downstream feeding of a sheet dispensed into said gap between said friction wheel and said feed belt having a guide wheel.

10. The apparatus of claim 7 including a downstream feed belt operatively coupled to said feed belt having a guide wheel for downstream feeding of a sheet dispensed into said gap between said friction wheel and said feed belt having a guide wheel.

11. The apparatus of claim 10 including sheet sensing means for sensing a sheet at a pre-determined location on said downstream feed belt, said sheet sensing means having an output operatively associated with said control means for prompting said control means to deactivate said coupling means in order to decouple said feed belt having a guide wheel from said continuously rotating drive.

12. A method of selectively feeding sheets singly from a plurality of stacks thereof, comprising the following steps:

continuously rotating a drive shaft having a plurality of drive wheels mounted for rotation therewith;

selecting at least one feeder and moving a guide wheel of a feed belt of each selected feeder such that the feed belt of each selected feeder contacts an associated one of said plurality of drive wheels and is thereby driven;

stepping a friction wheel spaced above the feed belt of each selected feeder so that a sheet from a stack of sheets associated with said friction wheel is singly fed from the bottom of said stack into a gap between said friction wheel and said feed belt.

13. The method of claim 12 including the step of moving said guide wheel of each selected feeder such that the feed belt of each selected feeder moves out of contact with said associated one of said plurality of drive wheels after a sheet is fed from the bottom of the stack associated with each selected feeder.

14. The method of claim 12 including, for each selected feeder, the step of sensing a sheet dispensed through the gap between said friction wheel and said feed belt and moving the guide wheel of said feed belt out of contact with said associated one of said plurality of drive wheels in response to said sensing.

* * * * *